United States Patent [19]

Blanchard

[11] 4,026,459

[45] May 31, 1977

[54] PLASTIC CONTAINER CLOSURE

[75] Inventor: Richard Lewis Blanchard, Barrington, Ill.

[73] Assignee: American Can Company, Greenwich, Conn.

[22] Filed: June 19, 1975

[21] Appl. No.: 588,499

[52] U.S. Cl. ..... 229/43; 220/306

[51] Int. Cl.² ..... B65D 43/10; B65D 51/16

[58] Field of Search ..... 229/43, 1.5 B; 215/6; 220/306, 60 R; 206/519, 520

[56] References Cited

UNITED STATES PATENTS

| | | | |
|---|---|---|---|
| 2,864,546 | 12/1958 | Aldington | 229/43 |
| 2,922,563 | 1/1960 | Aldington | 229/43 |
| 2,956,721 | 10/1960 | Bennett | 229/43 |
| 3,065,875 | 11/1962 | Negodo | 220/306 |
| 3,805,991 | 4/1974 | Cheladze | 229/43 X |
| 3,883,036 | 5/1975 | Mahaffy | 220/306 |

*Primary Examiner*—Davis T. Moorhead

*Attorney, Agent, or Firm*—Robert P. Auber; Ira S. Dorman; George P. Ziehmer

[57] ABSTRACT

A plastic closure adapted for frictional mounting upon the rim of a cup or the like has an upstanding brim extending about a central panel, which brim has a downwardly opening channel therein for seating the cup rim. A series of discrete compound protuberances project into the channel from the outside wall of the brim, and provide a discontinuous bead which engages the rim of the cup. The protuberances are configured to afford facile mounting on the cup and secure retention thereon while, at the same time, ensuring ready stripping from the male forming member on which the closure is molded. The inside wall of the closure is configured to ensure close fitting sealing engagement with the inner surface of the cup, and is dimensioned to do so without causing buckling, such as would, in turn, tend to produce leakage from the closed container. In general, the configuration of the closure adapts it for use with containers having a variety of rim configurations and a range of dimensions.

6 Claims, 4 Drawing Figures

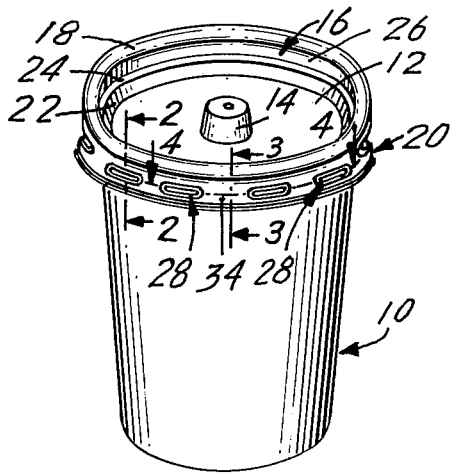
FIG. 1
FIG. 2
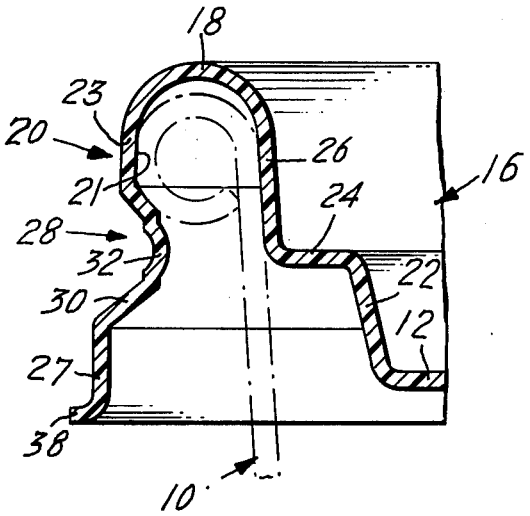
FIG. 3
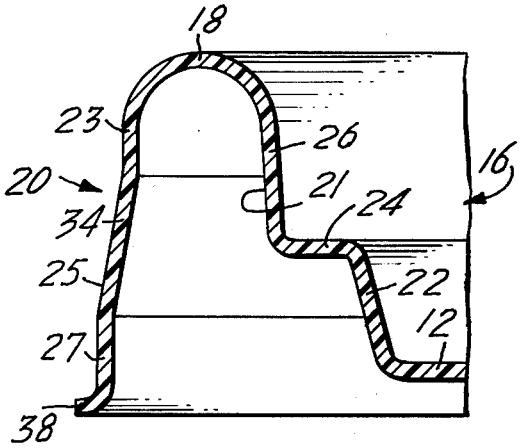
FIG. 4
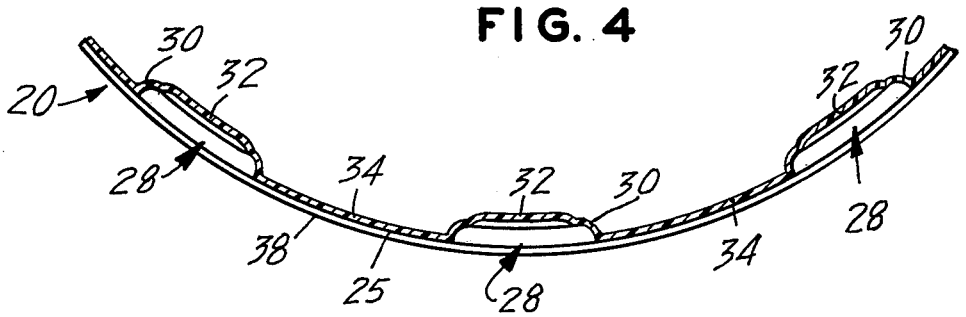

PLASTIC CONTAINER CLOSURE

BACKGROUND OF THE INVENTION

Disposable plastic closures or lids, designed for use in connection with paper and plastic containers of various types, (e.g., cups, food tubs, and the like) are, of course, well known. Moreover, such closures have been provided with a wide variety of means for effecting engagement on the container. Notwithstanding this, a need remains for a closure of this sort which is readily mounted and securely seated on the container, resistant to inadvertent disengagement therefrom and is, at the same time, readily strippable from the forming molds and otherwise convenient to manufacture.

Accordingly, it is an object of the present invention to provide a novel closure of thin, flexible, plastic construction, which is adapted for close-fitting interference mounting upon the rim of a container, which affords a high level of retention thereon, and which is adapted for use with containers having a variety of rim configurations and a range of rim dimensions.

It is also an object of the invention to provide such a closure which is easy to align with, and is effectively and facilely mounted on, the container.

Another object is to provide a closure having the foregoing advantages and features, which is in addition readily strippable from the tooling on which it is produced, and is otherwise convenient and economical to manufacture.

SUMMARY OF THE DISCLOSURE

It has now been found that the foregoing and related objects of the invention are readily attained in a closure of thin, flexible plastic construction, adapted for interference mounting upon the rim of a container, comprising a panel, and an upstanding peripheral brim extending thereabout. The brim includes an upwardly-extending inner wall portion adjacent the panel, a top wall portion extending outwardly from the upper part of the inner wall portion, and an outer wall portion depending from the outer part of the top wall portion, with the inner, top and outer wall portions defining a downwardly-opening channel about the panel within the brim. The outer wall has on its inner surface a series of discrete compound protuberances providing a discontinuous bead spaced downwardly from the top wall. Each protuberance includes a substantially rectilinear elongated base element and a narrower, substantially rectilinear elongated ridge element projecting further inwardly into the channel therefrom. The protuberances, and the portions of the outside wall therebetween, are dimensioned and configured to permit one of the protuberances to be disengaged from the rim of a container on which the closure is mounted, without displacement of the adjacent protuberances therefrom.

In the preferred embodiments of the invention, the base element of the protuberances is of oblong configuration. The top and bottom of the base element are desirably defined by upper and lower elongated shoulders which converge toward one another, with each of the shoulders forming an angle with the adjacent part of the outside wall of less than about 48°. Generally, the base element will extend inwardly about 0.02 inch from the upwardly-adjacent part of the outside wall, and the ridge element will extend about 0.005 to 0.015 inch therebeyond, 0.005 inch being preferred. Each of the protuberances and the portions of the outside wall therebetween may be about 0.3 inch in length, and most desirably the protuberances and such portions will be substantially equal in length.

Ideally, the portions of the outside wall below the protuberances and the lower part of the portions between the protuberances cooperate to provide a continuous, substantially smooth marginal band entirely about the lower edge of the outside wall. The band may be about 0.04 to 0.1 inch in height, and preferably it will be about 0.08 inch high. In most instances, the closure will have a top wall which is of curvilinear cross section, and which merges smoothly with the inside wall and the outside wall thereof; it will generally be of substantially semicircular cross section.

In especially preferred embodiments of the invention, the inside wall of the closure has a first section adjacent the panel extending generally upwardly therefrom, a second section extending generally outwardly from the upper part of the first section, and a third section extending generally upwardly from the outer part of the second section and merging with the top wall. The second section will generally be an annulus about 0.04 to 0.10 inch, and preferably about 0.065 inch, wide. The first section of the inside wall is desirably of frustoconical configuration, typically at least about 0.04 inch in height and forming an angle of about 105° with the second section thereof. Usually, the closure will be substantially circular and adapted for assembly with a cup, and it is most desirably made of a plastic of such composition and of sufficient thinness to permit stretching to occur therein upon assembly with a container; high impact polystyrene may suitably be used.

BRIEF DESCRIPTION OF THE DRAWING

FIG. 1 is a perspective view of a closure embodying the present invention, mounted on a cup;

FIG. 2 is a fragmentary, vertical sectional view of the closure of FIG. 1 along line 2—2 thereof, drawn to a greatly enlarged scale and showing the rim of the cup in phantom line;

FIG. 3 is a fragmentary, vertical sectional view of the closure of FIG. 1 along line 3—3 thereof, drawn to the scale of FIG. 2; and FIG. 4 is a fragmentary, horizontal sectional view of the closure of FIG. 1 along line 4—4 thereof, and drawn to a scale somewhat enlarged therefrom.

DETAILED DESCRIPTION OF THE ILLUSTRATED EMBODIMENT

Turning now in detail to the appended drawing, therein illustrated is a closure of thin, flexible plastic construction embodying the present invention, mounted upon a container, generally designated by the numeral 10. The closure includes a circular planar central panel 12 having at its center an upstanding boss 14, the latter having a small hole formed therethrough to constitute vent means on the closure, and being of relatively small area, so as to minimize the sacrifice of rigidity in the panel 12. The brim of the closure comprises an inside wall, generally designated by the numeral 16, a top wall 18 of generally semicircular cross section, and an outside wall, generally designated by the numeral 20; the top wall 18 merges smoothly with the inside wall 16 and the outside wall 20, and the three walls 16, 18, 20 define a downwardly-opening channel 21 in the brim (directional references being made with respect to the closure in its normally mounted position).

The inside wall 16 comprises a plug lead-in section 22, an annular plug offset section 24 and a plug section 26; the lead-in section 22 and the plug section 26 are both of frustoconical configuration, with the angle of taper of the former being greater than that of the latter. The outside wall 20 comprises an upper band 23, an intermediate band 25 and a marginal band 27, the upper and marginal bands 23, 27 being generally cylindrical and the intermediate band 25 being frustoconical. A series of compound, oblong protuberances, generally designated by the numeral 28 are formed in the intermediate band 25, and project inwardly therefrom at space locations thereabout to cooperatively define a discontinuous bead within the channel 21 of the brim. The phrase "discontinuous bead", used herein, is intended to define a longitudinally aligned relationship of the protuberances (as illustrated), so as to provide an interference or snap-fit characteristic to the closure. Each protuberance 28 consists of a base element 30 and a narrower ridge element 32, the latter being centrally disposed on the former and extending inwardly therefrom. The marginal band 27 terminates in a short, outwardly-projecting lip portion 38.

As can best be seen in FIG. 2, the closure is mounted upon the cup 10 with the rim of the latter seated in the upper portion of the channel 21 of the brim, closely adjacent the top wall 18 and with the sidewalls 16, 20 bearing thereon. The plug section 26 of the inside wall 16 is snugly seated upon the inner surface of the rim of the cup 10 to provide an effective seal thereat, and the protuberances 28 underlie the circular bead of the rim of the cup 10 to maintain the desired assembly by engagement therebeneath. It should be appreciated that the relationship between the cup 10 and the closure depicted in FIG. 2 is primarily for purposes of illustration, and does not represent the actual relationship that will exist in many practical instances. Thus, the position of the protuberances 28 relative to the cup rim bead will depend upon the relative dimensions of the latter. The illustrated relationship may exist if the rim dimensions are relatively small. However, one or both of the elements 30, 32 of the protuberances 28 will be brought to bear upon a larger bead, and this will generally occur through stretching in the upper part of the cup brim; preferably, the ridge 32 of the protuberances will engage the cup rim. It should also be appreciated that, in general, it is the ridge element 32 of the protuberances 28 that affords the maximum cup gripping power of the closure and, in turn, enables the closure to have a relatively light-weight, thin construction.

Generally, the diameter of the plug section 26 of the inside wall 16 will be greater than the inside diameter of the cup for which the closure is designated, and ideally it will be selected to best accommodate a particular cup configuration. Seating the cup rim in the channel 21 will generally not only cause stretching to occur in the upper portion of the brim, but it will also tend to deform the plug section 26 to a more greatly tapered configuration, since the angle of taper of the section 26 will normally be less than that of the cup with which the closure is used; in fact, section 26 may be cylindrical, if so desired.

The section 24 and, to a lesser extent, the section 22 influence the resistance of the plug section 26 to distortion due to the presence of the cup. In the absence of the offset section 24, the plug 26 would tend to buckle and to form channels through which the product could leak from the closed container. On the other hand, if the offset section 24 were excessively wide, it would tend to hamper compression, and thereby render assembly unduly difficult. In the optimal case, therefore, the width of the section 24 will be selected to provide sufficient force against the inner surface of the cup to ensure an adequate seal while, at the same time, not imparting an undue level of stiffness to that section of the closure. Similarly, if the lead-in section 22 is too short, it will not provide adequate flexure and, if too long, holding power and sealing effectiveness will be adversely affected. In addition to the foregoing factors, these features of the inside wall 16 of the closure afford tolerance to container variations, and also enable stacking of filled containers, one upon the other, without disengagement of the closures and with a relatively high level of stability. As can be seen from the drawings, it is preferred that the plug offset section 24 be transversely aligned with the vertical center of the protuberances 28 of the outside wall 20.

The protuberances 28 and the portions 34 therebetween are dimensioned and configured to promote facile mounting of the closure onto the cup, secure retention thereon, and a significant measure of resistance to inadvertent disassembly therefrom. Ideally, the portions 34 provide sufficient flexibility and independent movement of the protuberances 28 to enable disengagement of one of them from under the cup rim, without causing the displacement of those adjacent to it. The attainment of this feature depends, to some extent, upon the flexibility of the material from which the closure is fabricated; however, the length and depth of the protuberances, and the spacing therebetween, are of prime importance in this regard.

If the protuberances 28 are too short or too shallow, they will readily slip from beneath the cup rim with the application of upward force upon the closure. Moreover, if the spaces 34 between adjacent protuberances 28 are insufficient to afford adequate resiliency, lifting of one protuberance from under the rim will cause it to "lead" the adjacent protuberances, and thereby tend to reduce the level of resistance of the closure to inadvertent disassembly. In particular, it was found that, in a closure designed for a conventional six ounce frustoconical cup, a 0.3 inch spacing and protuberance length was highly satisfactory, whereas leading and inadequate holding power resulted from the use of 0.25 inch dimensions; the latter also tended to preclude practical stripping of the closure from the male forming member on which it was molded. Although desirable, it should be noted that the protuberances 28 and the portions 34 therebetween need not be of the same length.

With further regard to the stripping characteristic of the closure of the present invention from the male forming member, the compound configuration of the protuberances 28 not only permits the ridge elements 32 to extend well into the channel 21 for secure retention on the container, but it also provides the base elements 30 which afford sufficient flexibility to enable facile stripping. The angle of the upper and lower shoulders of the base element 30 of the protuberances 28 is of considerable significance with respect to this feature of the closure. While shallow angles will permit easier stripping, they will also result in a sacrifice of holding power; the same is true of the use of relatively flexible materials.

The continuous marginal band 27 is also significant to satisfactory stripping, in tending to prevent outward expansion in the area of its juncture with the band 25 under the vertical upward force which is applied during stripping; in its absence, binding on the mold would tend to occur. It might also be mentioned that the marginal band 27 serves to maintain the protuberances 28 under the rim of the cup on which the closure is mounted; in a typical case, a marginal band 0.08 inch high was found to be optimal. The flange 38 at the bottom of the band 27 provides some added strength and tends somewhat to facilitate mounting. Moreover, when the closures are to be used in an automated operation, in which they are moved by a shuttle-type mechanism (such as in food packaging), the flange 38 may be utilized and, for that purpose, may be extended somewhat.

It should be noted that a closure is provided in which the degree of retention can be adjusted and controlled as desired, such as through changes of protuberance design, variations of the inside wall configuration (especially the plug offset section thereof) and by utilizing various gages of the plastic material. Concerning the latter point, the structural features of the closure permit, in some instances, the plastic to be of a lighter gage than was heretofore feasible (e.g., the thickness may be as low as 0.009 inch or less) while maintaining adequate holding power. As has been mentioned, a preferred material for the closure is impact polystyrene which exhibits some stretch in the thicknesses utilized; however, other synthetic resinous materials may be substituted, as will be apparent to those skilled in the art, and the material need not exhibit stretch. Although a so-called "hot drink closure" having a vent is depicted in the drawing, it will be understood that the concepts of the invention are comparably applicable to closures for cold drinks, food packages, etc.

Thus, it can be seen that the present invention provides a novel closure of thin, flexible plastic construction, which is adapted for close-fitting interference mounting upon the rim of a container. It affords a high level of retention thereon, it is adapted for use with containers having a variety of rim configurations and a range of rim dimensions, and it is easily aligned with, and effectively and faciley mounted on, the container. The closure of the invention is also readily strippable from the tooling on which it is produced, and is otherwise convenient and economical to manufacture.

Having thus described the invention, what is claimed is:

1. A closure of thin, flexible plastic construction adapted for interference mounting upon the rim of a container, comprising a panel, and an upstanding peripheral brim extending thereabout, said brim including an upwardly extending inner wall portion adjacent said panel, a top wall portion extending outwardly from the upper part of said inner wall portion, and an outer wall portion depending from the outer part of said top wall portion, with said inner, top and outer wall portions defining a downwardly-opening channel about said panel within said brim, said outer wall having on its inner surface a series of discrete, peripherally extending and peripherally spaced compound protuberances providing a discontinuous bead spaced downwardly from said top wall, each of said protuberances including a substantially rectilinear, peripherally elongated and inwardly projecting base protrusion, and a narrower, substantially rectilinear, peripherally elongated ridge protrusion disposed substantially within said base protrusion and projecting further inwardly into said channel therefrom, said protuberances and the portions of said outside wall therebetween being dimensioned and configured to permit one of said protuberances to be disengaged from the rim of a container on which said closure is mounted without displacement of the adjacent protuberances therefrom.

2. The closure of claim 1 wherein said base protrusion and said ridge protrusion of said protuberances are each of oblong configuration.

3. The closure of claim 2 wherein the top and bottom of said base protrusion are defined by upper and lower elongated shoulders which converge toward one another, each of said shoulders forming an angle with the adjacent part of said outside wall of less than about 48°.

4. The closure of claim 1 wherein the portions of said outside wall below said protuberances and the lower part of said portions between said protuberances cooperate to provide a continuous, substantially smooth marginal band entirely about the lower edge of said outside wall.

5. The closure of claim 1 wherein said inside wall has a first section adjacent said panel extending generally upwardly therefrom, a second section extending generally outwardly from the upper part of said first section, and a third section extending generally upwardly from the outer part of said second section and merging with said top wall.

6. The closure of claim 1 wherein said closure is substantially circular, and is adapted for assembly with a cup.

* * * * *